US008099903B2

(12) United States Patent
Smink

(10) Patent No.: US 8,099,903 B2
(45) Date of Patent: Jan. 24, 2012

(54) DOOR SYSTEM, DOOR SUB-SYSTEM AND A VEHICLE PROVIDED WITH A DOOR SYSTEM

(75) Inventor: Pieter Smink, Winsum (NL)

(73) Assignee: De Nooijer Beheer B.V., Bolsward (NL)

( * ) Notice: Subject to any disclaimer, the term of this patent is extended or adjusted under 35 U.S.C. 154(b) by 513 days.

(21) Appl. No.: 12/088,690

(22) PCT Filed: Oct. 2, 2006

(86) PCT No.: PCT/NL2006/000496

§ 371 (c)(1),
(2), (4) Date: Mar. 29, 2008

(87) PCT Pub. No.: WO2007/037687

PCT Pub. Date: Apr. 5, 2007

(65) Prior Publication Data

US 2008/0231083 A1 Sep. 25, 2008

(30) Foreign Application Priority Data

Sep. 30, 2005 (NL) ..... 1030075
Jan. 25, 2006 (NL) ..... 1031003

(51) Int. Cl.
*E05D 15/10* (2006.01)

(52) U.S. Cl. ..... 49/218; 49/215; 49/209

(58) Field of Classification Search ..... 49/209, 49/210, 215, 216, 218, 219, 220, 211
See application file for complete search history.

(56) References Cited

U.S. PATENT DOCUMENTS

| | | | | | |
|---|---|---|---|---|---|
| 1,375,689 | A * | 4/1921 | Gallagher | 49/219 |
| RE28,443 | E * | 6/1975 | Ross, Jr. et al. | 49/220 |
| 4,142,327 | A | 3/1979 | Griffith et al. | |
| 4,495,729 | A * | 1/1985 | Britzke et al. | 49/212 |
| 4,924,625 | A | 5/1990 | Dilcher | |
| 5,207,024 | A * | 5/1993 | Epema et al. | 49/360 |
| 6,030,024 | A * | 2/2000 | Schmidhuber et al. | 296/146.12 |
| 6,094,866 | A * | 8/2000 | Busnelli | 49/219 |
| 2006/0225356 | A1 * | 10/2006 | Jarolim | 49/209 |
| 2006/0225357 | A1 * | 10/2006 | Bortoluzzi | 49/213 |
| 2008/0231083 | A1 * | 9/2008 | Smink | 296/202 |

FOREIGN PATENT DOCUMENTS

| | | | |
|---|---|---|---|
| DE | 2 216 898 | A | 11/1972 |
| EP | 0 536 528 | B1 | 4/1993 |
| NL | 282 836 | A | 5/1964 |
| WO | 90/12184 | A1 | 10/1990 |
| WO | WO 2007037687 | A1 * | 4/2007 |

* cited by examiner

*Primary Examiner* — David Dunn
*Assistant Examiner* — David E Allred
(74) *Attorney, Agent, or Firm* — Shewchuk IP Services, LLC; Jeffrey S. Shewchuk

(57) ABSTRACT

A door system has at least one door leaf and a displacement system for the door leaf. The door leaf is connected to an organ that is moveable between two suspension points, wherein the first suspension point is situated at a greater distance from the plane of the entrance opening than the second suspension point. A track system is provided, for moving the door leaf in two phases, wherein the track system in the first phase rotationally moves a side of the door leaf outward, and in the second phase determines a displacement of the door leaf by a displacement of the organ from the first suspension point in the direction of the second suspension point.

11 Claims, 9 Drawing Sheets

1
38
30
4
19b
19a
3
132

31'
21'
24
2
33
36
29
8
37

6
34
35
5

DOOR SYSTEM, DOOR SUB-SYSTEM AND A VEHICLE PROVIDED WITH A DOOR SYSTEM

CROSS-REFERENCE TO RELATED APPLICATIONS

The present application is a national phase application under 35 U.S.C. 371 of PCT/NL2006/000496, filed Oct. 2, 2006.

BACKGROUND OF THE INVENTION

The present invention relates to a door system comprising:

at least one door leaf for closing off an entrance opening, for instance that of a vehicle, wherein the entrance opening is at least defined by a first doorpost and a second doorpost, wherein the door leaf has a first side and a second side, wherein in a situation where the entrance opening is closed off, the door leaf is situated between the first and second doorpost, the first side of the door leaf is situated near the first doorpost and the second side of the door leaf is situated near the second doorpost;

a displacement system for moving the door leaf between a first position and a second position, wherein in the second position the door leaf provides access to the entrance opening.

Such a door system is generally known in the art, for instance with vehicles such as buses.

SUMMARY OF THE INVENTION

The object of present invention is to provide an improved door system.

To this end the door system according to the invention is characterized in that:

the displacement system provides two suspension points for the door leaf, wherein the door leaf is connected to an organ that is movable between the two suspension points, wherein the first suspension point is situated at a greater distance from a plane passing through the first and the second doorpost, than the second suspension point;

a rotation axis is provided, which is situated at a distance from the second side, the door leaf being rotatable around said rotation axis; and the displacement system comprises a track system so as to be able to move the door leaf from the first position to the second position in two phases, wherein the track system as a consequence of a translation of the movable organ from the first position to the second position, in the first phase determines a rotation of the door leaf around the rotation axis for making the second side of the door leaf move away from the plane to beyond the second doorpost, and the track system in the second phase determines a rotation of the door leaf around the rotation axis in the opposite direction of the first phase by a displacement of the organ from the first suspension point in the direction of the second suspension point.

Thus, a door system is provided that, by means of a relatively simple construction (with relatively few components), combines a high degree of reliability with increased comfort for those entering a space via an entrance opening equipped with the door system. In contrast to most known door systems that move fully outward during a first phase, with the door system according to the present invention predominantly only the second side of the door leaf moves outward during the first phase. The likelihood that a person positioned in front of the door system will be startled, or the amount of fright he/or she experiences when the door opens is thereby reduced. According to the invention the two suspension points are situated (at least for a period of time during the opening and/or closing of the door) on a line that is at an angle relative to said plane, and the movable organ is movable between the two suspension points. As a result, with respect to the first and the second position of the door leaf only a small correction of the trajectory is required, which is provided by the track system. The phrase "at a distance from the second side" means that the distance from the second side is larger than the distance from the first side. A possible embodiment for achieving the required rotation of the door leaf is to provide a rotation axis (substantially vertically arranged) between the door leaf and the movable organ. This rotation axis can be situated in the door leaf, against the door leaf, near the movable organ or be part of a supporting arm which connects the door leaf and the movable organ. In this embodiment the movable organ is movable along a fixed rod. A suspension point is the final location of a door system where the weight of a door leaf is transferred to a fixed part of a vehicle, a space or the like in which the door leaf is mounted. EP 0 536 528discloses a system having two suspension points which are situated at an equal distance from the plane defined by the doorposts. The system disclosed in this patent has two fixed rotation axes around which 2arms can rotate, said arms being connected by a rod along which a movable organ can be moved. This construction is relatively vulnerable and complicated.

In a preferred embodiment, the rotation axis is a fixed rotation axis and the first fixed rotation axis is formed by the first suspension point, and the second suspension point is a suspension point that is movable around the fixed rotation axis.

This has as an advantage that the door leaf is more stable, for instance during wind pressure on the door leaf or because of leaning against the door leaf. Here the door leaf will be fixed to the movable organ.

According to a preferred embodiment, the displacement mechanism comprises a rodless cylinder extending from a first position to a second position, wherein the cylinder comprises a movable slide and the slide is connected to the movable organ in such a way that the movable organ can be carried along.

Thus, the door leaf can be positioned in the desired first or second position by means of the movable organ, in a simple manner.

In such a case it is preferred that the slide is connected to the movable organ by means of an hinge system.

Thus, the change of the angle between the trajectory followed by the slide and the trajectory followed by the movable organ, which change occurs during positioning the door leaf from the first position into the second position (and vice versa), can be compensated for in a simple manner.

An interesting embodiment is characterized in that the linear actuator is movable in its axial direction such that operating the linear actuator results in a displacement of the actuator in the opposite direction of the displacement of the movable actuator part, the first end of the linear actuator being movably connected to an end of a first arm of a V-shaped lever which is movable around a rotation axis situated outside the longitudinal axis of the linear actuator, such that a longitudinal displacement of the linear actuator results in a rotation of the V-shaped lever around the rotation axis, wherein the end of the second arm of the V-shaped lever is connected to a pull-push rod which at its other end is connected to an end of a first arm of a second V-shaped lever, wherein the end of the second arm of the second V-shaped lever is co-operatively connected to a track system at the door leaf, and wherein the V-shaped levers are rotatable around rotation axes provided between the respective arms of the V-shaped levers.

The linear actuator thus effects two movements: the moving outward of the second side in the first phase, and carrying the door leaf to the second position by means of the movable actuator part. An example of a suitable linear actuator is, for instance, a motor having a threaded rod, wherein the motor (or actually its housing) represents the movable actuator part.

A particular embodiment is characterized in that the rodless cylinder is movable in its axial direction such that applying a difference in pressure over the slide in the cylinder provides a displacement of the cylinder opposite to the displacement of the slide, the first end of the cylinder being movably connected to an end of a first arm of a V-shaped lever which is movable around a rotation axis situated outside the longitudinal axis of the cylinder, such that a longitudinal displacement of the cylinder effects a rotation of the V-shaped lever around the rotation axis, wherein the end of the second arm of the V-shaped lever is connected to a pull-push rod which at its other end is connected to an end of a first arm of a second V-shaped lever, wherein the end of the second arm of the second V-shaped lever is co-operatively connected to a track system at the door leaf, and wherein the V-shaped levers are rotatable around rotation axes provided between the respective arms of the V-shaped levers.

Thus, it can be effected in a simple and effective manner that the second side is effectively brought out of the plane, to beyond the second doorpost. The rodless cylinder thus effects two movements: the moving outward of the second side in the first phase and carrying the door leaf to the second position by means of the slide.

Advantageously, the track system comprises a double sided tread along which running wheels, which are connected to the second V-shaped lever, are carried, said running wheels having a substantially rigid orientation with respect to the second V-shaped lever, and wherein the line through the centers of the running wheels is perpendicular to the tread of the track system.

Thus, the trajectory covered by the door leaf can be effectively defined to have only little play. Advantageously, the track system co-operates with the door leaf and is at least partially part of it. That means that the track system may in fact comprise more than 1 track system, of which at least 1 is situated in the door leaf. This is further elucidated in the working examples.

According to an advantageous embodiment, one end of the tread situated at the second side is curved away from the second V-shaped lever, such that during a displacement of the door leaf to the first position the running wheels are positioned at opposite sides against the curved part of the double sided tread, and such that the second side of the door leaf is forced into a position against the second post.

Thus, it is effectively achieved that the second side can be moved outward in the first phase. Especially for electrically driven doors it is advantageous if such curved portions are present in both the upper part of the door leaf as well as in the lower part of the door leaf in order to ensure that, even when the door leaf is not actively held in a closed position, the first side of the door leaf is pushed against the first post along the entire height of the first side, thus avoiding tilting of the door leaf. For pneumatic doors it will in general suffice to use, preferably in the lower part of the door leaf, 1 curved end enclosed by the running wheels, whereas in the upper part of the door leaf, for instance, a correspondingly curved guiding channel may be present in which a reliable operation of that part of the door leaf can already be ensured with just 1 running wheel.

An advantageous embodiment is characterized in that, when the door leaf is in the first position, the line through the connecting point of the first end of the pull-push rod with the second arm of the first V-shaped lever, and the connecting point of the second end of the pull-push rod with the first arm of the second V-shaped lever, lies between the point of rotation of the first V-shaped lever and the connecting point of the cylinder with the first V-shaped lever, and at the side of the line that is turned away from the point of rotation when the door leaf is in the second position.

This is helpful in maintaining the door leaf in a second position, since it has to pass a dead point before the entrance opening can be closed.

For the sake of simplicity of the description, the present invention has been described as a door system comprising at least one door leaf. However, in practice sometimes door systems without door leaves are supplied to consumers. Therefore the invention also relates to a door sub-system corresponding with the door system described above, except that the door leaf is lacking, and that the door sub-system is suitable for connecting a door leaf to the movable organ.

Finally, the present invention relates to a vehicle comprising a door system according to the invention.

BRIEF DESCRIPTION OF THE DRAWINGS

The present invention will now be illustrated by the drawing, where

FIG. 2*a-e* show a schematic top plan view of the door system of FIG. 1;

DETAILED DESCRIPTION OF THE PREFERRED EMBODIMENT(S)

Figure 1:
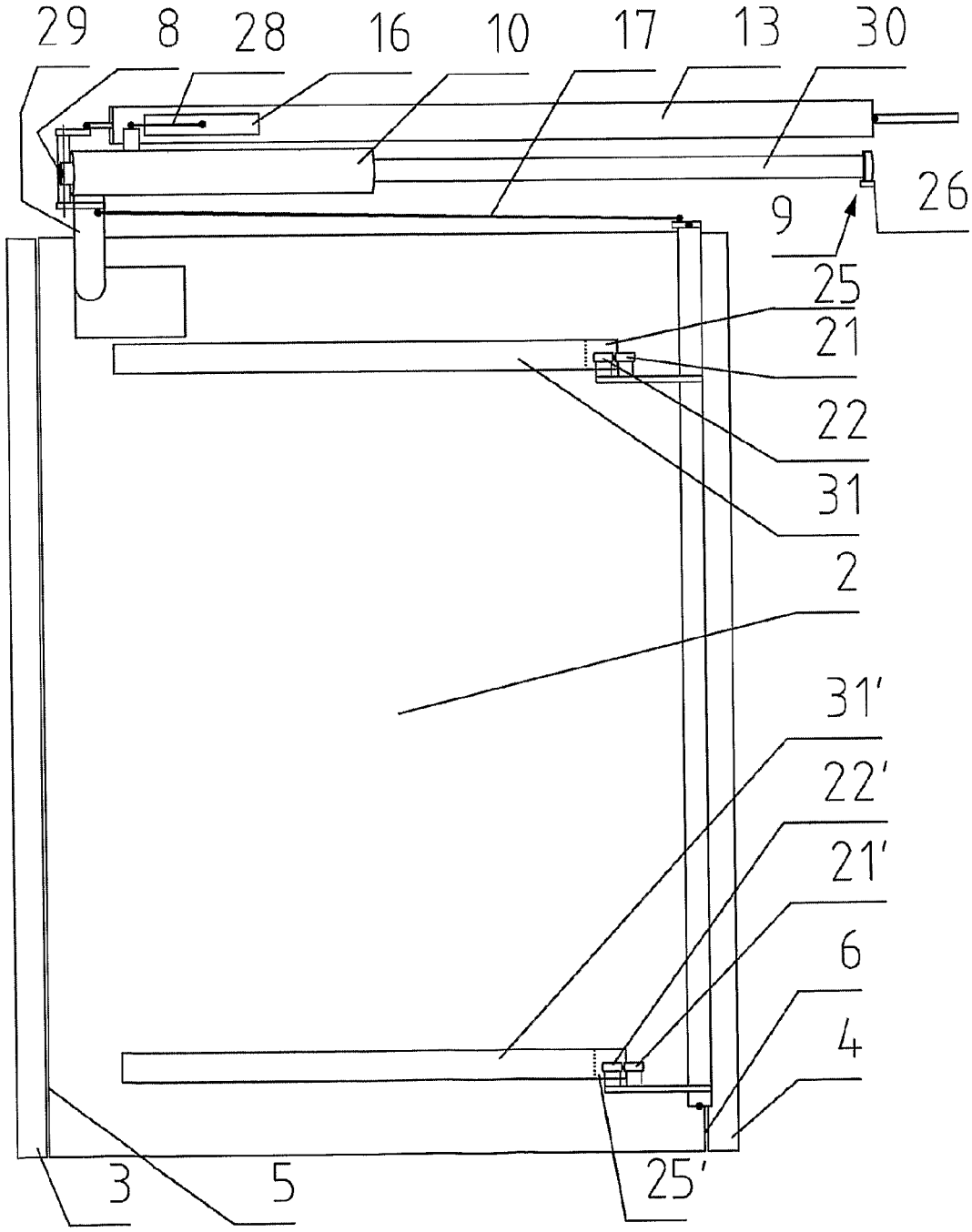
FIG. 1 shows a door system according to the invention disposed above the entrance opening of a bus.

FIG. 1 shows a part of a bus provided with a door system 1. The door system 1 comprises a door leaf 2 which, in the situation shown here, closes off an entrance opening of the bus. The entrance opening is defined at opposite sides by a first doorpost 3 and a second doorpost 4. The door leaf 2 has a first side 5 and a second side 6. When the entrance opening is closed off, the second side 6 is situated near the second doorpost 4.

Figure 2A:
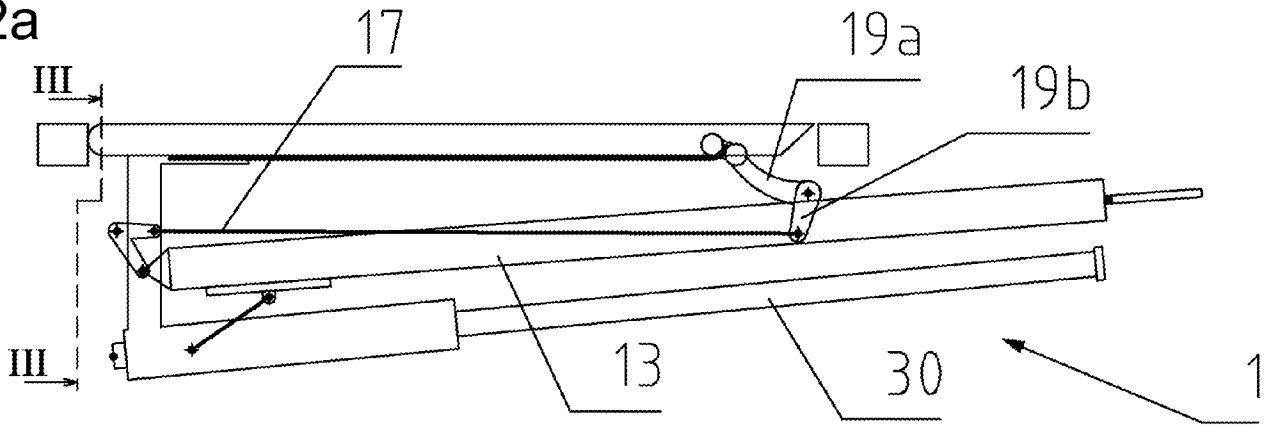
Figure 2B:
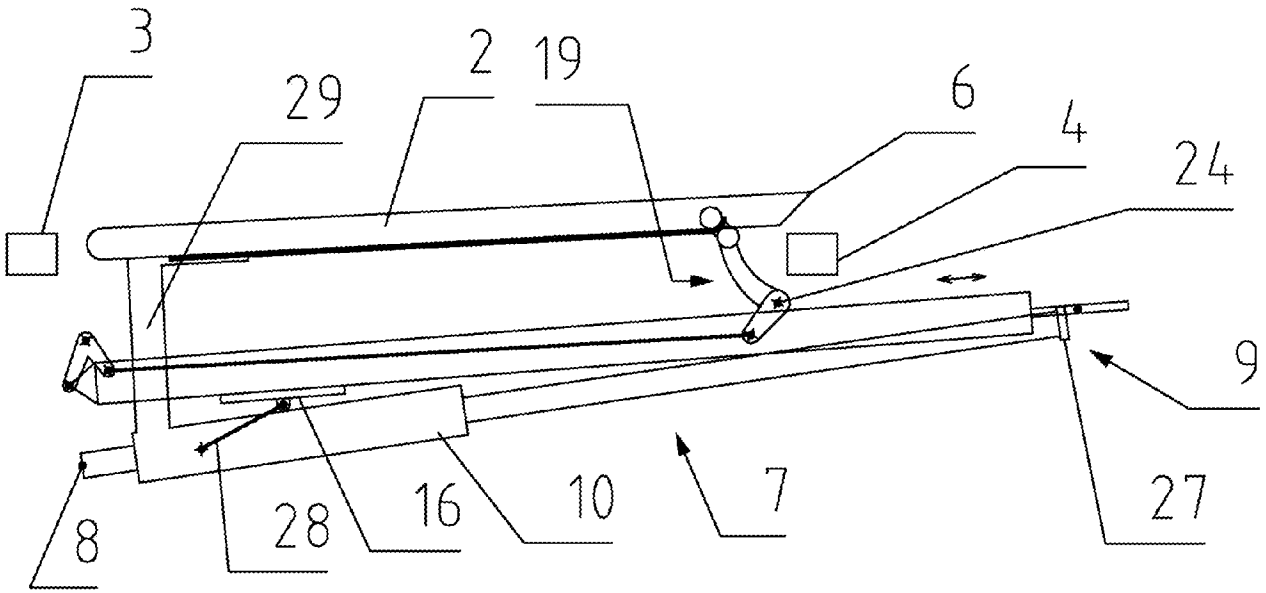
Figure 2C:
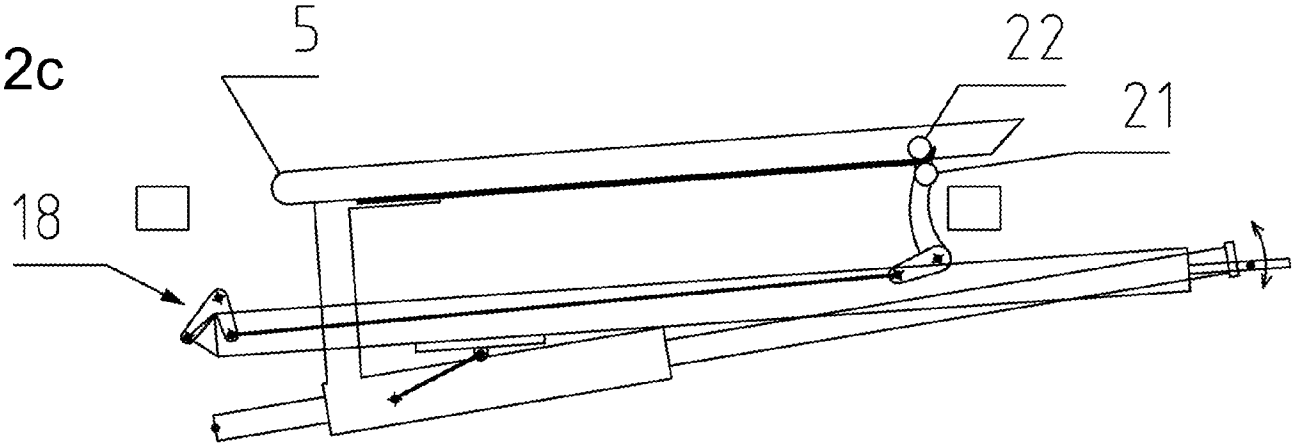
Figure 4A:
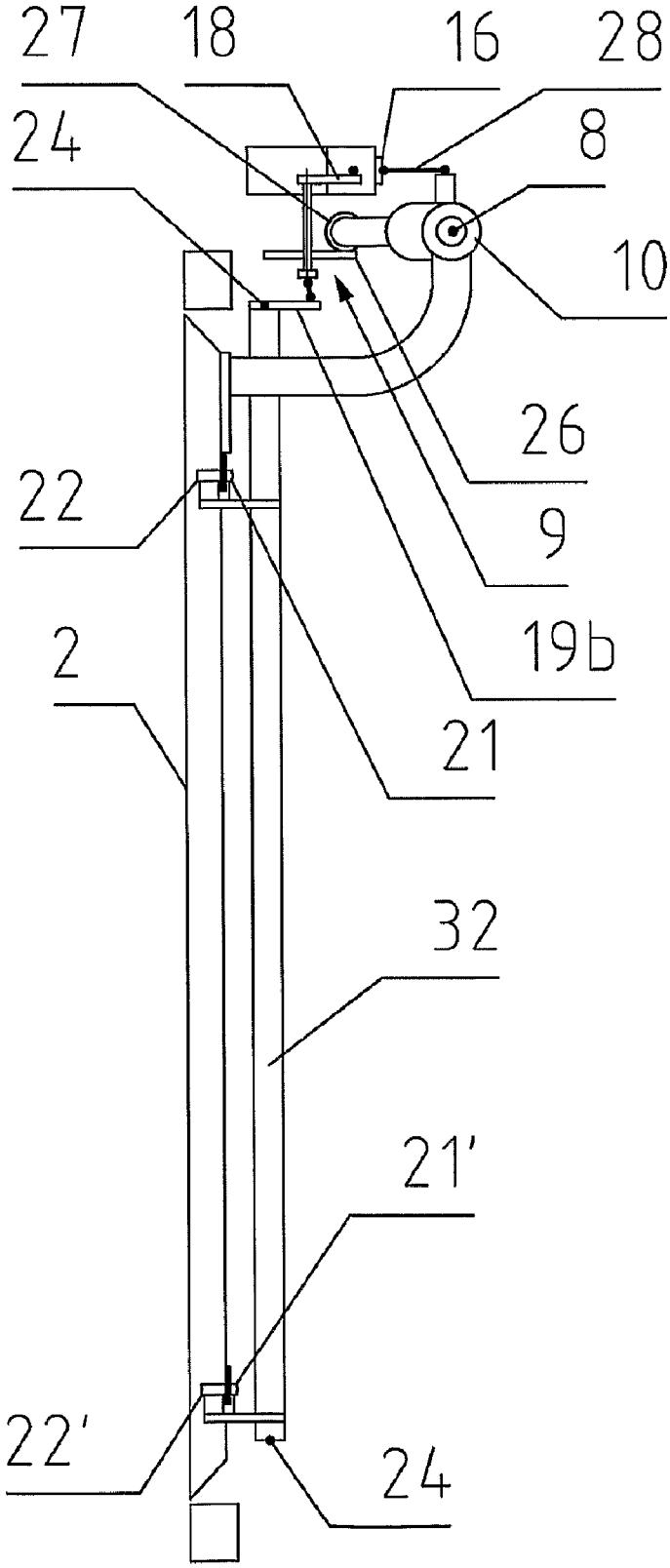
FIGS. 4*a* and 4*b* show two side views along line IV-IV of FIG. 2*e*, wherein these figures correspond with FIGS. 2*a* and 2*e* respectively.

For bringing the door leaf 2 from a closed position to an open position (or vice versa), the door system 1 according to the invention has a displacement system 7 which comprises a movable organ 10. When the door system 1 is mounted, this movable organ 10 is fixed to the door leaf 2 via a supporting arm 29. In the embodiment illustrated here the movable organ 10 is in the form of a sleeve that is movable along a rod 30. The door leaf 2 is suspended from a first suspension point 8 and a second suspension point 9 via the movable organ 10. The first suspension point 8 functions as a fixed rotation axis. This means that the rotation axis does not undergo translation, at least not in the horizontal plane. The use of suspension points 8, 9 determines that the door leaf is arranged in a vertical position or at least in a substantially vertical position, and that the rotation axis 8 is at an angle with the vertical which is substantially equal to that of the door leaf, and preferably equal. The second suspension point 9 is rotatable around this fixed rotation axis (FIG. 2*c*). According to the embodiment illustrated here, the second suspension point 9 comprises a tread 26 (FIG. 4*a*) and a small wheel 27 that is arranged co-axially with the rod 30. Other embodiments are conceivable, such as a slide bearing.

Figure 2D:
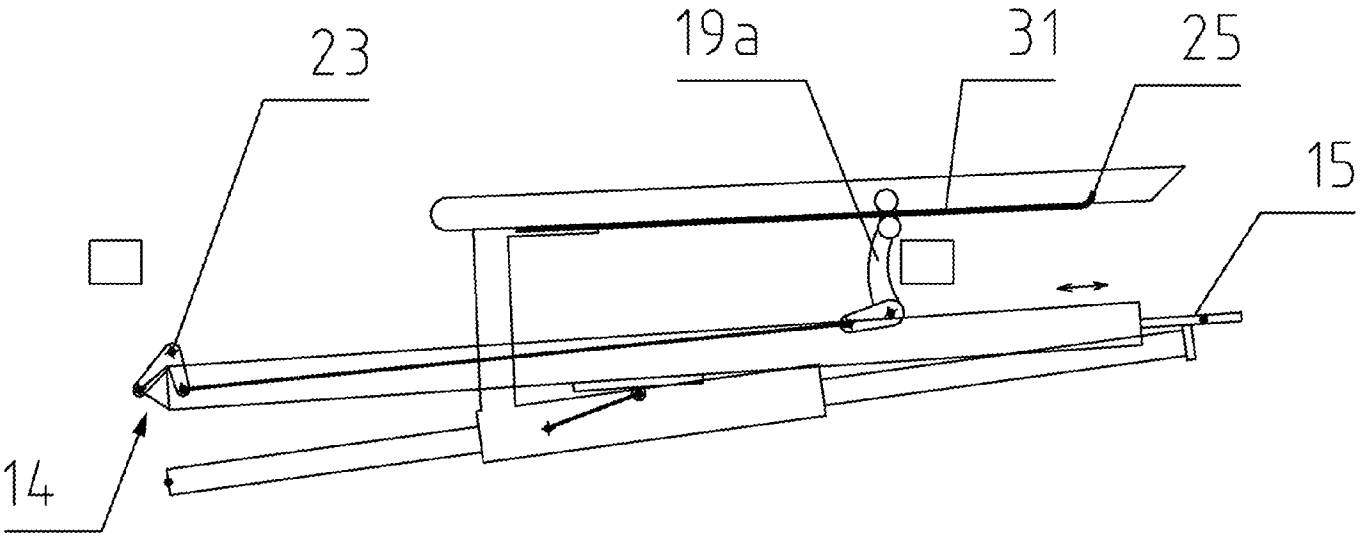

The opening of the entrance opening closed by the door leaf 2 will be illustrated with reference to FIG. 2*a-e*. In FIG. 2*a* the door leaf 2 is in the first, closed position. In FIG. 2*e* the door leaf 2 is in the second position wherein the entrance opening can be accessed. The FIGS. 2*b-d* show intermediate positions of the door leaf 2. According to the invention, during the opening of the door, the door leaf 2 with its second side 6 is moved outward (first phase) and a translation of the door leaf 2 makes it such that the door leaf ultimately reaches the second position (second phase), the door leaf being (substantially) parallel to its original position (i.e. that of the closed position). In the absence of the second doorpost 4, that would correspond to a translation at an angle $\alpha$ to a plane 11 (FIG. 2*e*) formed by the first and second doorposts 3, 4. In the present application the terms 'within' and 'outside' are used with respect to the plane 11, wherein 'outside' is the side where the door leaf 2 is in the second position (as shown in FIG. 2*e*). An important aspect of the present invention is that the arrangement of the suspension points 8, 9 is adapted to the translation vector of the door, which in practice means that the line on which the two suspension points are lying (or defined a little more strictly, the line projected on a horizontal plane) makes a comparable angle with the plane 11, which angle preferably deviates by less than 10° , and more preferably by less than 5° of $\alpha$, and preferably is equal to $\alpha$ (FIG. 3), when the door is in the first position. For designing a door system 1 according to the invention a designer will determine the desired starting position and end position of a point on the door leaf 2 in the middle of the first and the second side and thereto determine the $\Delta x$ and $\Delta y$ value (wherein the plane 11 functions as the X-axis). $\alpha$ can be calculated using the formula $$\tan(\alpha)=(\Delta x/\Delta y)$$

Deviations with respect to a are permissible although as a consequence the track systems will have to adjust more. In general, according to the invention, the angle with the plane will be 1-10°, preferably 2-6°.

Figure 3:
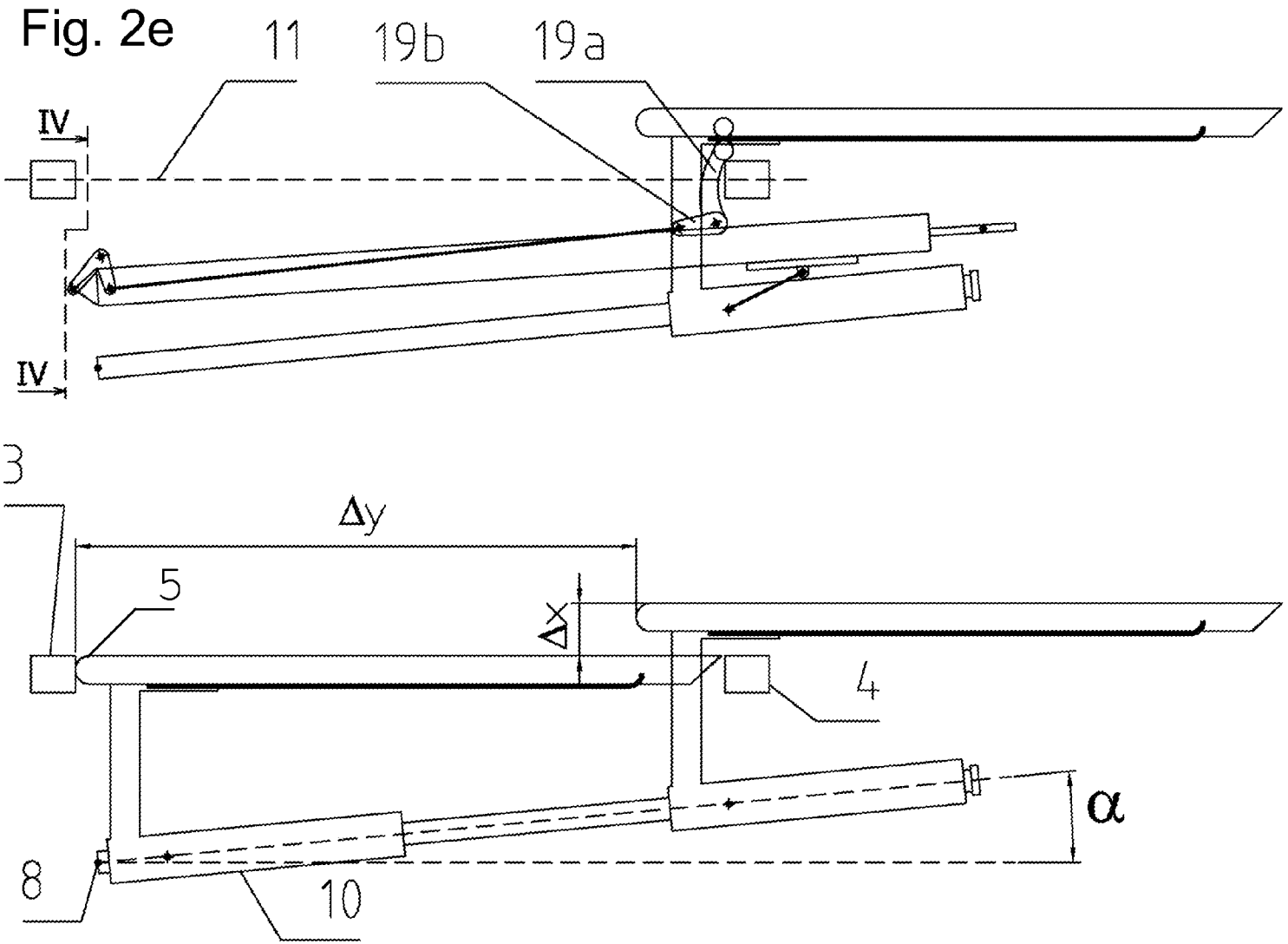
FIG. 3 corresponds with FIG. 2*e* to provide an explanation on angle $\alpha$.

If the door leaf 2 in the first position is parallel to the door leaf in the second position, any point of the door leaf may be used, with the first side 5 as illustrated in FIG. 3. In special cases, such as a vehicle like a tram which has a tapered front end and/or back end in which an entrance opening is present, it will be preferred not to have the door leaf parallel to the plane 11 in the second position but parallel to the side of the vehicle. In such a case the angle between the line and the side of the vehicle can advantageously be selected from the angles $\alpha'$ and $\alpha''$ (for the first side and the second side respectively). Also in the cases where one chooses not to have the door leaf parallel to the sidewall of the vehicle (or room) in the second position, can these angles $\alpha'$ and $\alpha''$ be calculated for selecting a suitable angle of the line.

The overall movement is to a large extent afforded by moving the movable organ 10 along the rod 30 which rod 30 is arranged at an angle that, as indicated above, is preferably equal to $\alpha$. According to the invention, in the first phase the second side 6 is moved outward to a larger extent than the first side 5. Thus, the second post 4 can be passed. In order to facilitate this, the second side 6 may also have a beveled edge as can be seen in FIG. 2. For that matter the first and second side 5, 6 are customarily provided with rubber profiles, which seal against doorposts 3, 4 and allow for tolerances. The deviation of the translation movement determined by the rod 30 is afforded by the rotation of the rod 30 around the first suspension point B. This rotation is determined by a track system 20.

In the embodiment shown the track system 20 comprises a guiding strip 31, 31' having an outwardly curved end 25 (FIG. 2; 25' not represented). At each side of the guiding strip 31 two running wheels 21, 22, respectively 21', 22' are located which are connected via arms 19*a*, 19'*a* of V-shaped levers 19, 19' to a turning rod 32. The running wheels of each pair 21, 22 respectively 21', 22' are located playfree at opposite sides of the respective guiding strip 31, 31', and the rotation axes are substantially located in line with the rotational axes of the turning rod 32. The running wheels 21, 22 respectively 21', 22' are consequently located perpendicular to the guiding strips 31, 31'. For the curved end 25, 25' this means that a translation in the direction of the plane 11 of the door effects the rotation of the turning rod 32, causing the second side 6 to turn outward.

According to a preferred embodiment this rotational movement can be further facilitated by means of pull-push rod 17, which will be explained later. Firstly, the translation movement of the movable organ 10 along the rod 30 will be dilated upon further.

For the embodiment described here, in order to move the movable organ 10 along the rod 30, use is made of a rodless cylinder 13. This possesses a slide 16 which can be moved pneumatically along a major part of the length of the rodless cylinder 13 by applying pressure. This is known per se by the skilled artisan and for the sake of simplicity of the drawing and the description all components of the pressure system and its controls have been omitted.

If the rodless cylinder 13 is not at the same angle relative to the plane 11 as the rod 30, then a flexible connection 28 between the slide 16 and the movable organ 10 is necessary. Here a hinged rod 28 is opted for. The arrangement of the rodless cylinder 13 is not critical and it could for instance also have run parallel to the plane 11.

Now, the function of pull-push rod 17 will be explained. According to a preferred embodiment the rodless cylinder 13 is suspended freely and it can move between the globally indicated positions 14, 15. Thanks to the free suspension, the rodless cylinder 13 itself will move in the direction of position 14, as a result of the appliance of a pressure over the rodless cylinder 13, which moves the slide 16 in such a way that the door leaf 2 moves to the second, open position. Consequently, a first V-shaped lever 18 is moved which rotates around a rotation axis 23. The V-shaped lever 18 is also connected to the pull-push rod 17, which in turn is connected to the arm 19*b* of the second V-shaped lever 19 of the turning rod 32. Since the rodless cylinder 13 in practice has less mass and can be displaced more easily than the totality of the movable organ 10, supporting arm 29 and door leaf 2, the rodless cylinder 13 will cover a larger distance than the movable organ 10 (and thus the door leaf 2 in the direction of the second doorpost 4), as a result of which the turning rod 32 is thus turned at the start (the first phase) and therewith moves the second side 6 outward. A track system comprising a combination of the curved end 25 and the pull-push rod 17 provides an extremely reliable operation of the door system 1 according to the invention.

In FIG. 2*e* the door leaf 2 is in the second position, wherein the entrance opening can be accessed. When the door leaf 2 is moved to the first position, the arm 19*b* of the V-shaped lever is substantially in line with the pull-push rod 17. At that particular moment the free suspension of the rodless cylinder 14 does not yet offer the possibility to exert a substantive rotational force on the turning rod 32, as a result of which the translation of the door leaf along the guide 20 is not unnecessarily impeded (i.e. complicated because of friction). Once the running wheels 21, 22, respectively 21', 22' reach the end 25, respectively 25', rotation of the first V-shaped lever 18 does become possible and the movement of the rodless cylinder 13 helps turning the second side 6 inward again.

In the embodiment shown here the suspension points 8, 9 of the door system according to the invention have been provided above the entrance opening. Within the scope of the present invention it is conceivable that instead these are provided at the underside and for instance are integrated into a floor. After assembly, the first suspension point 8 is fixed, in any way, with respect to the entrance opening. This may be done directly, for instance through a connection to the body or the chassis of a vehicle (or the wall of a room), or indirectly, in that the suspension point 8 is connectedly fixed to a frame or housing of the door system, which frame or housing is connectedly fixed to the body etc. The same applies for the tread 26 of the second suspension point 9.

The embodiment described hereinbefore is the embodiment of the invention preferred by the applicant since it has the most advantages. Now, an alternative embodiment will be described with reference to FIGS. 5 and 6.

Figure 4B:
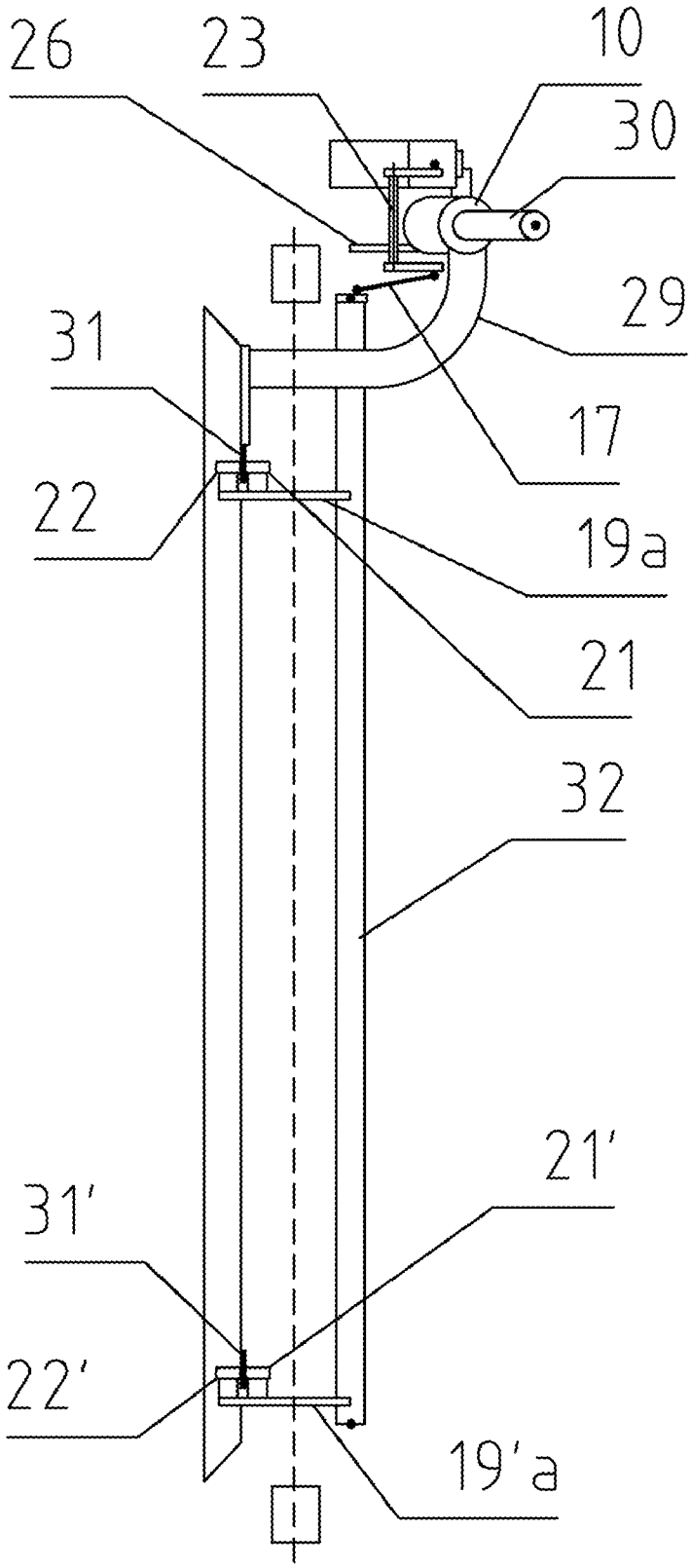
Figure 5:
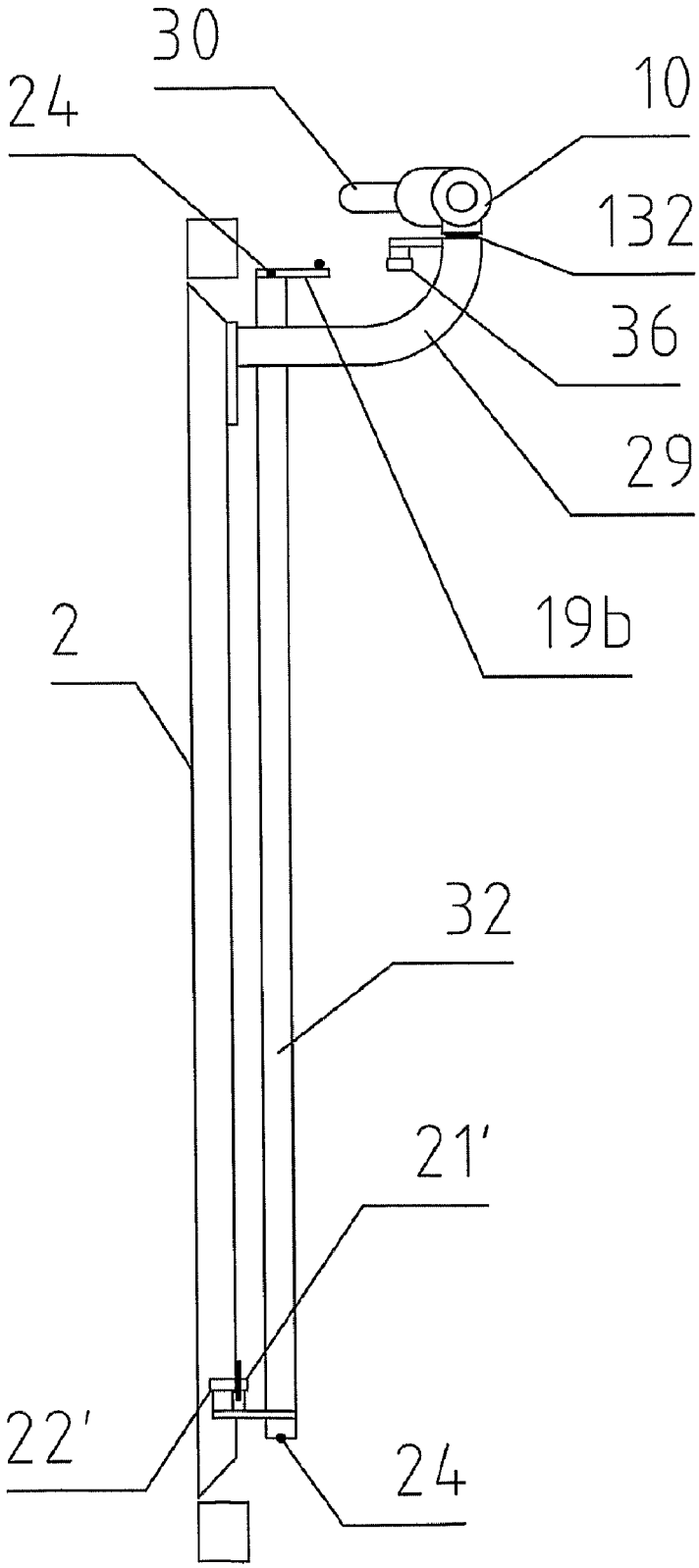
FIG. 5 shows a side view of an alternative embodiment of a door system according to the invention.
Figures 6A, 6B, 6C:
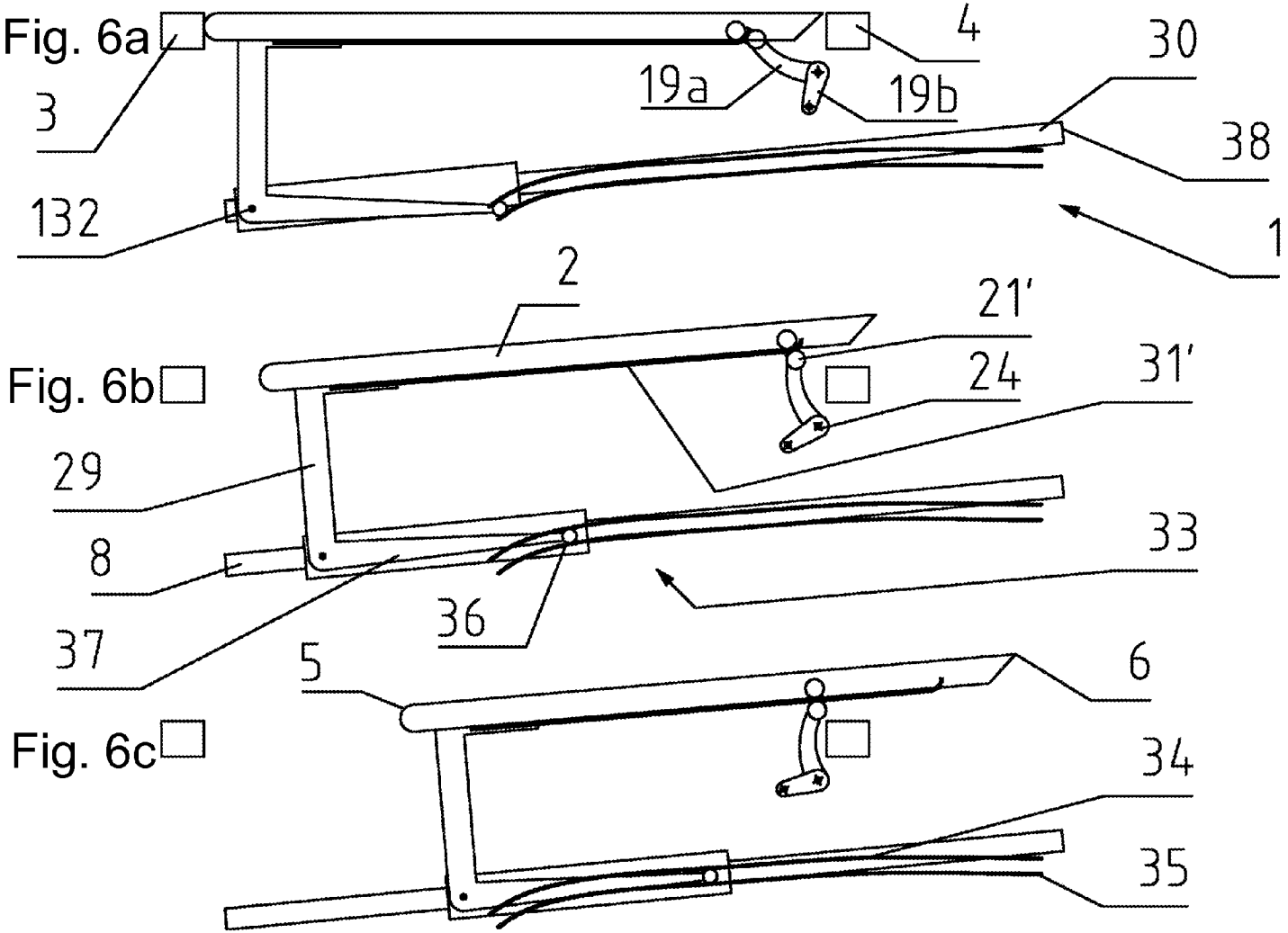
FIG. 6*a-e* show a schematic top plan view of the alternative embodiment shown in FIG. 5.
Figures 6D, 6E:
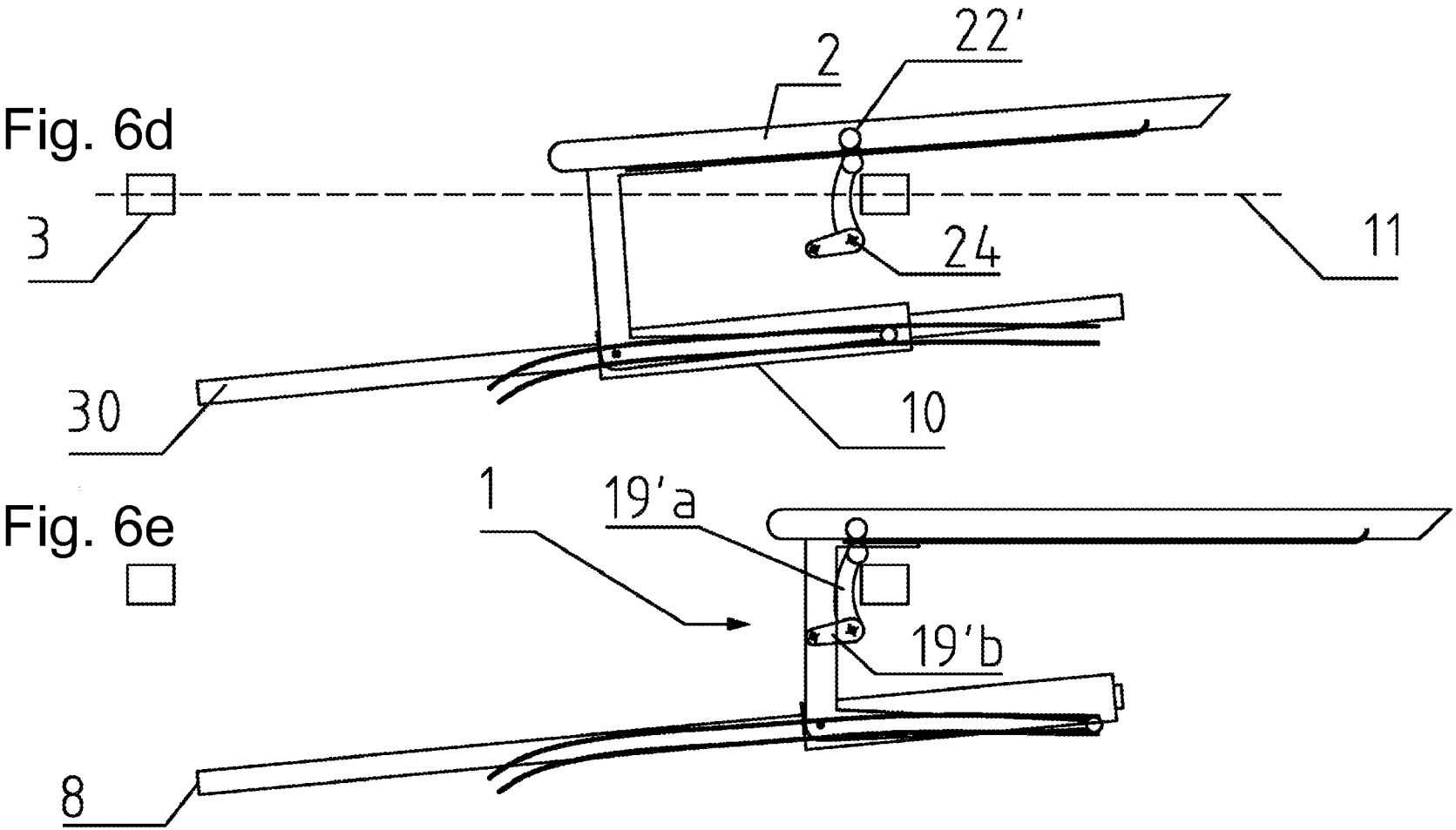

In this embodiment the rod 30 has a second fixed suspension point 38 in addition to the fixed suspension point 8. In order to turn the door leaf 2 outward when bringing it from the first position into the second position, the supporting arm 29 is connected to the movable organ 10 via a vertical rotation axis 32. Near the rod 30 a track system 33 is provided, which here comprises two guiding strips 34, 35 which define a curved trajectory, and a running wheel 36 movable between the guiding strips 34, 35. The running wheel 36 is connected via an arm 37, which substantially extends in the same direction as the rod 30, to the supporting arm 29. The running wheel 36 is rotatable around a vertical axis 132 at the end of the arm 37. The connection between the arm 37 and the supporting arm 29 is rigid. The shape of the guiding strips 34, 35 determines the trajectory covered by the running wheel 36 between the guiding strips 34, 35. In FIG. 5 the guiding strips 34, 35 have been omitted. The guiding strips 34, 35 are shaped such that during the movement from the first position into the second position, the running wheel 36 is strongly moved in the direction of the second doorpost 4, as a consequence of which the arm 37 rotates acutely with respect to the rod 30 and, because of the fixed connection between the arm 37 and the supporting arm 29, the door leaf 2 with the second side 6 turns outward, allowing it to pass the second doorpost 4, and the second side 6 is drawn inward when moving from the second position to the first position in the last phase thereof. In FIG. 6*a-e* five steps are shown wherein in FIG. 6*a* the door leaf 2 is in the first position and in FIG. 6*e* it is in the second position. FIG. 6 also shows the track system 20 comprising the guiding strip 31' and the running wheels 21', 22'. In fact, a reliable operation of the door system in general necessitates a track system or combination of track systems that provide guidance both at the lower part of the door leaf 2 as well as at the upper part of the door leaf 2. For the convenience of interpreting the drawing, in FIGS. 4 and 5 the upper doorway header and lower doorway footer of the door opening are also shown by means of rectangles, although with respect to these upper doorway header and lower doorway footer no particular problems need to be resolved.

For the sake of simplicity the invention has been described on the basis of an entrance opening having one door leaf only. Within the scope of the present invention it is, however, just as possible to close the entrance opening with 2 door leaves which, in the closed position, are situated near or even against each other and, in the open position are situated further away from one another. In that case the first and second doorpost for the first door leaf are the second and first doorpost for the other door leaf. In other words, apart from cases where door leaves have different widths, the door system will substantially be a mirror image door system. Where in the above description and at the discussion of the examples a rodless cylinder is mentioned, also any actuator, in particular a linear actuator, that can effect a substantially linear movement, such as a linear motor, a motor having a screw spindle or other actuators known in the art for this purpose is meant. Instead of pressure, the particular actuator is then powered in such a manner as is appropriate for the particular actuator.

The invention claimed is:

1. Door system comprising:

at least one door leaf for closing off an entrance opening, wherein the entrance opening is at least defined by a first doorpost and a second doorpost, wherein the door leaf has a first side and a second side, wherein in a situation where the entrance opening is closed off, the door leaf is located between the first and second doorposts, the first side of the door leaf is situated near the first doorpost and the second side of the door leaf is situated near the second doorpost;

a displacement system coupled to the door leaf and supported relative to the first and second doorposts for moving the door leaf between a first position closing off the entrance opening and a second position providing access to the entrance opening, characterized in that:

the displacement system comprises a suspension rod having two suspension points on the suspension rod, wherein the door leaf is connected to an organ supporting the door leaf on the suspension rod, the organ being movable between the two suspension points, wherein a first of the suspension points is situated at a greater distance from a plane passing through the first and the second doorposts than a second of the suspension points, the door leaf being supported by the organ at a set non-parallel angle of the door leaf relative to the suspension rod such that the angle of the door leaf relative to the suspension rod does not change during translation of the organ and door leaf along the suspension rod;

a fixed rotation axis of the suspension rod is provided which is situated at a distance from the second side and at or adjacent the first suspension point, the fixed rotation axis being stationary relative to the first doorpost and the second doorpost, the door leaf, the movable organ and the second suspension point being rotatable around said fixed rotation axis; and the displacement system comprises a track system so as to be able to move the door leaf from the first position to the second position in two phases, wherein the track system as a consequence of a translation of the movable organ from the first position to the second position, in the first phase determines a rotation of the door leaf around the rotation axis for making the second side of the door leaf move away from the plane to beyond the second doorpost, and the track system in the second phase determines a rotation of the door leaf around the rotation axis in the opposite direction of the first phase by a displacement of the organ from the first suspension point in the direction of the second suspension point.

2. Door system according to claim 1, wherein the displacement system comprises a linear actuator extending from a first position to a second position, wherein the linear actuator comprises a movable actuator part and the movable actuator part is connected to the movable organ in such a way that the movable organ can be carried along by movement of the movable actuator part.

3. Door system according to claim 2, wherein the movable actuator part is connected to the movable organ by means of a hinge system.

4. Door system according to claim 2, wherein the linear actuator is movable in its axial direction such that operating the linear actuator results in a displacement of the actuator in the opposite direction of the displacement of the movable actuator part, a first end of the linear actuator being movably connected to an end of a first arm of a first V-shaped lever which is movable around a first lever rotation axis situated outside the longitudinal axis of the linear actuator, such that a longitudinal displacement of the linear actuator results in a rotation of the first V-shaped lever around the first lever rotation axis, wherein an end of a second arm of the first V-shaped lever is connected to a first end of a pull-push rod, an opposing second end of the pull-push rod being connected to an end of a first arm of a second V-shaped lever, wherein an end of a second arm of the second V-shaped lever is co-operatively connected to the track system at the door leaf, wherein the second V-shaped lever is movable around a second lever rotation axis, and wherein the first lever rotation axis is located between the first and second arms of the first V-shaped lever, and wherein the second lever rotation axis is located between the first and second arms of the second V-shaped lever.

5. Door system according to claim 4, wherein the linear actuator is a rodless cylinder having a slide which is movable in its axial direction such that applying a difference in pressure over the slide in the cylinder provides a displacement of the cylinder opposite to the displacement of the slide.

6. Door system according to claim 4, wherein the track system comprises a double sided tread along which running wheels, which are connected to the second V-shaped lever, are carried, said running wheels having a substantially rigid orientation with respect to the second V-shaped lever, and wherein a line through a centre of the running wheels is perpendicular to the tread of the track system.

7. Door system according to claim 6, wherein one end of the tread situated toward the second side of the door leaf is curved away from the second V-shaped lever, such that during a displacement of the door leaf to the first position the running wheels are positioned at opposite sides against a curved part of the double sided tread, and such that the second side of the door leaf in the first position is forced against the second post.

8. Door system according to any claim 4,wherein, when the door leaf is in the first position a line through a connecting point of the first end of the pull-push rod with the second arm of the first V-shaped lever, and through a connecting point of the second end of the pull-push rod with the first arm of the second V-shaped lever, lies between the first lever rotation axis and a connecting point of the linear actuator with the first V-shaped lever or is coincident with the first lever rotation axis.

9. The door system of claim 1 mounted on a vehicle.

10. Door system comprising:

at least one door leaf for closing off an entrance opening, wherein the entrance opening is at least defined by a first doorpost and a second doorpost, wherein the door leaf has a first side and a second side, wherein in a situation where the entrance opening is closed off, the door leaf is located between the first and second doorposts, the first side of the door leaf is situated near the first doorpost and the second side of the door leaf is situated near the second doorpost;

a displacement system coupled to the door leaf and supported relative to the first and second doorposts for moving the door leaf between a first position closing off the entrance opening and a second position providing access to the entrance opening, characterized in that:

the displacement system comprises a suspension rod having two suspension points on the suspension rod, wherein the door leaf is connected to an organ supporting the door leaf on the suspension rod, the organ being movable between the two suspension points, wherein a first of the suspension points is situated at a greater distance from a plane passing through the first and the second doorposts than a second of the suspension points, the door leaf being supported by the organ at a set non-parallel angle of the door leaf relative to the suspension rod such that the angle of the door leaf relative to the suspension rod does not chane durin translation of t he organ and door leaf along the suspension rod;

a rotation axis of the suspension rod is provided which is situated at a distance from the second side, the rotation axis being stationary relative to the first doorpost and the second doorpost, the door leaf being rotatable around said rotation axis; and the displacement system comprises a track system so as to be able to move the door leaf from the first position to the second position in two phases, wherein the track system as a consequence of a translation of the movable organ from the first position to the second position, in the first phase determines a rotation of the door leaf around the rotation axis for making the second side of the door leaf move away from the plane to beyond the second doorpost, and the track system in the second phase determines a rotation of the door leaf around the rotation axis in the opposite direction of the first phase by a displacement of the organ from the first suspension point in the direction of the second suspension point; and the displacement system comprises a linear actuator extending from a first position to a second position, wherein the linear actuator comprises a movable actuator part and the movable actuator part is connected to the movable organ in such a way that the movable organ can be carried along by movement of the movable actuator part, the linear actuator being movable in its axial direction such that operating the linear actuator results in a displacement of the actuator in the opposite direction of the displacement of the movable actuator part, a first end of the linear actuator being movably connected to an end of a first arm of a first V-shaped lever which is movable around a first lever rotation axis situated outside the longitudinal axis of the linear actuator, such that a longitudinal displacement of the linear actuator results in a rotation of the first V-shaped lever around the first lever rotation axis, wherein an end of a second arm of the first V-shaped lever is connected to a first end of a pull-push rod, an opposing second end of the pull-push rod being connected to an end of a first arm of a second V-shaped lever, wherein the second V-shaped lever is movable around a second lever rotation axis, wherein an end of a second arm of the second V-shaped lever is co-operatively connected to the track system at the door leaf, and wherein the first lever rotation axis is located between the first and second arms of the first V-shaped lever, and wherein the second lever rotation axis is located between the first and second arms of the second V-shaped lever.

11. A door system comprising:

an entrance opening defined by a first doorpost and a second doorpost;

a suspension rod supported relative to the entrance opening between a first suspension point on the suspension rod and a second suspension point on the suspension rod, with the first suspension point being situated at a greater distance from a plane passing through the first and the second doorposts than the second suspension point, the suspension rod having a fixed rotation axis at or adjacent the first suspension point with the second suspension point being movable relative to the fixed rotation axis, the fixed rotation axis being stationary relative to the first doorpost and the second doorpost;

an organ riding on the suspension rod and movable in translation along the suspension rod;

a door leaf for selectively closing off the entrance opening by having a closed location between the first and second doorposts, the door leaf being supported by the organ at a set non-parallel angle of the door leaf relative to the suspension rod such that the angle of the door leaf relative to the suspension rod does not change during translation of the organ and door leaf along the suspension rod, the door leaf having a first side which in the closed location is situated near the first doorpost and a second side which in the closed location is situated near the second doorpost; and a track system coupled relative to the door leaf so as to guide the door leaf from the closed position to an open position in two phases, including a first phase making the second side of the door leaf move away from the plane to beyond the second doorpost in which the suspension rod, organ and door leaf collectively rotate about the fixed rotation axis in a first direction, and a second phase during substantial translation of the organ and supported door leaf on the suspension rod in which the suspension rod, organ and door leaf collectively rotate about the fixed rotation axis in an opposite direction.

* * * * *

UNITED STATES PATENT AND TRADEMARK OFFICE

CERTIFICATE OF CORRECTION

PATENT NO. : 8,099,903 B2
APPLICATION NO. : 12/088690
DATED : January 24, 2012
INVENTOR(S) : Pieter Smink It is certified that error appears in the above-identified patent and that said Letters Patent is hereby corrected as shown below:

At Col. 5, line 46, delete “with respect to a”, and insert therefor --with respect to α--.

At Col. 6, line 9, delete “point B”, and insert therefor --point 8--.

At Col. 10, line 28, delete “chane durin”, and insert therefor --change during--.

At Col. 10, line 29, delete “t he”, and insert therefor --the--.

Signed and Sealed this
Thirteenth Day of March, 2012

David J. Kappos

David J. Kappos
*Director of the United States Patent and Trademark Office*